United States Patent [19]

Roy et al.

[11] 4,095,514

[45] Jun. 20, 1978

[54] AIR POLLUTION CONTROL DEVICE

[75] Inventors: John R. Roy; Stephen Roy; Mary L. Roy, all of Cohasset; Daniel T. Mooney, Winchester, all of Mass.

[73] Assignee: Airtek Corporation, Quincy, Mass.

[21] Appl. No.: 739,458

[22] Filed: Nov. 8, 1976

[51] Int. Cl.[2] ..... F23L 17/02

[52] U.S. Cl. ..... 98/58; 110/184; 138/45; 251/212

[58] Field of Search ..... 98/58–60; 110/184; 126/307 R; 114/187; 251/212; 138/45, 46

[56] References Cited

U.S. PATENT DOCUMENTS

| | | | |
|---|---|---|---|
| 2,350,512 | 6/1944 | Lanning | 110/184 |
| 2,714,847 | 8/1955 | Suebel | 98/58 |
| 2,926,489 | 3/1960 | Halford et al. | 251/212 X |
| 3,115,820 | 12/1963 | Adelt | 98/60 |
| 3,809,314 | 5/1974 | Engelke et al. | 236/49 |
| 3,841,208 | 10/1974 | Knox | 98/58 |
| 3,894,563 | 7/1975 | Pausch | 138/45 |
| 3,904,127 | 9/1975 | Cash | 98/58 X |

*Primary Examiner*—William E. Wayner
*Assistant Examiner*—William E. Tapolcai, Jr.
*Attorney, Agent, or Firm*—Sewall P. Bronstein; Robert Gammons

[57] ABSTRACT

An air pollution control device for controlling the velocity of discharge from an industrial chimney or smokestack in order to optimize the plume rise and thereby minimize air pollution comprising a variable pitch truncated cone adapted to be mounted at or near the top of the chimney or stack, said cone being constructed to be expandable and contractible with respect to the axis of the chimney or associated flue or flues and kinematic means manually or automatically operable to control the size of the flow path of the gases through the truncated cone.

20 Claims, 13 Drawing Figures

AIR POLLUTION CONTROL DEVICE

BACKGROUND OF INVENTION

Draft controls have been designed for use in stovepipes as shown, for example, in U.S. Pat. Nos. 833,404 and 535,562 consisting of a cone made up of two or more sections pivotally mounted to the inner side of the pipe for expansion and contraction, thus to control the draft and economy of combustion. In contrast, the device of this invention is designed to control the velocity of discharge from industrial chimneys or smokestacks and, hence, to control the height of the plume so that dispersement of the solid particles and gases will take place beyond the aerodynamic downwash at the top of the chimney and thereby minimize air pollution. Such apparatus as shown in the aforesaid patents is neither designed to accomplish the foregoing, nor suggests its use for such a purpose.

SUMMARY OF INVENTION

As herein illustrated, the invention resides in a structure at or near the top of the chimney or stack designed to be expanded or contracted to control the velocity of discharge from the chimney or stack. Expansion and contraction may be accomplished manually or automatically so as to maintain a predetermined velocity or velocity range of discharge. The structure comprises essentially a variable pitch truncated cone mounted at or near the top of the chimney or stack, the truncated cone being constructed to be expanded and contracted and kinematic linkage for effecting such expansion and contraction. As herein illustrated, the cone is comprised of a plurality of blades arranged within a shell in a circle so as to be movable inwardly toward the axis of the chimney to vary the conical flow path defined by the blades. The aforesaid kinematic means may comprise means connected to some or all of the blades for moving them inwardly and outwardly; means for moving the blades inwardly and spring means for moving them outwardly or; means for moving them outwardly and spring means for moving them inwardly. There is means at the adjacent edges of the blades for maintaining the continuity of the cone throughout expansion and contraction and such means may comprise overlapping portions of the blades. The kinematic means for effecting movement of the blades may comprise mechanical linkage, worm and gear means, hydraulic ram means or electric motor means. Mechanical adjustment may be effected according to a predetermined chart of flow velocities to adjust the emission opening of the cone to a size to obtain optimum plume or automatically by means of velocity and/or pressure-sensing means situated in the flow path operably connected to effect operation of the hydraulic or electric motor means.

The invention will now be described with reference to the accompanying drawings, wherein.

Figure 12:
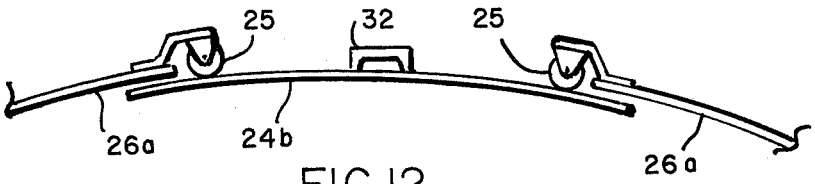
Figure 10:
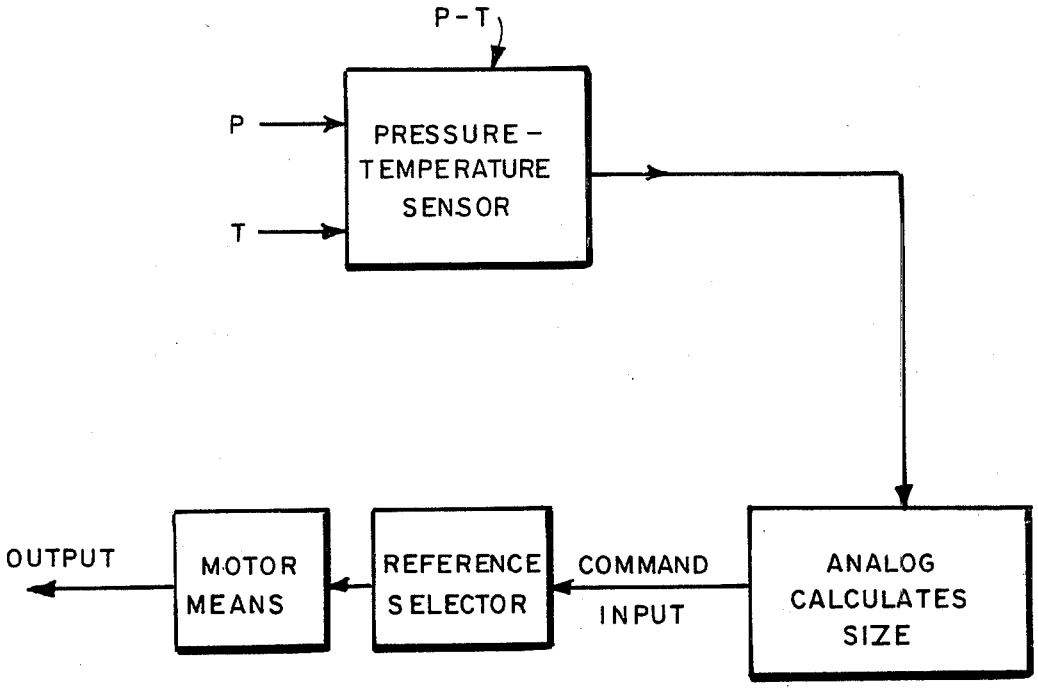
Figure 11:
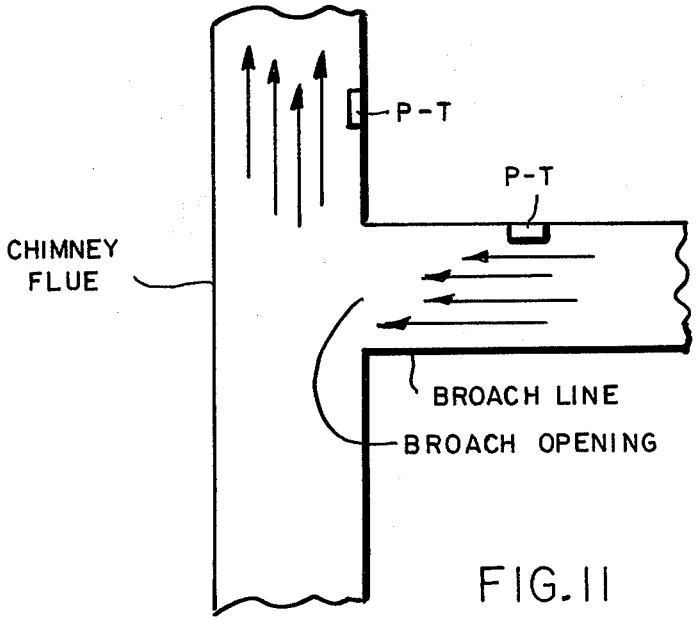

FIG. 10 diagrammatically shows the pressure temperature sensor means for effecting operation of the kinematic means whether mechanically, hydraulically or electrically operated in response to changes in the gas flow;

FIG. 11 diagrammatically illustrates two possible positions of the pressure temperature sensing means; and FIG. 12 is a partial diametral section showing one kind of antifriction means between blades.

Figure 1:
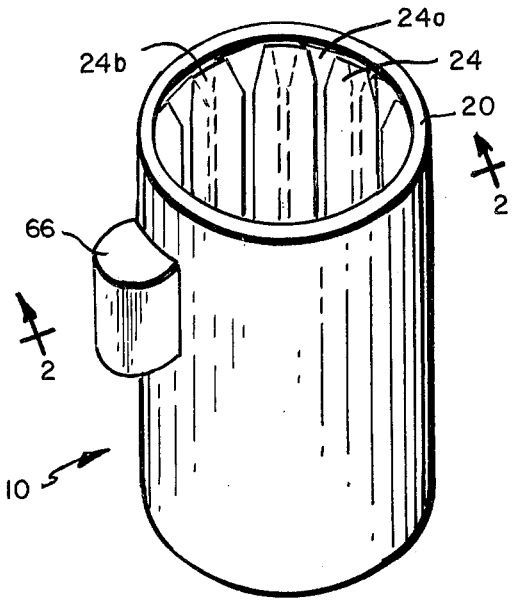
FIG. 1 is a perspective view of the device for mounting to the top of an industrial chimney or stack.
Figure 2:
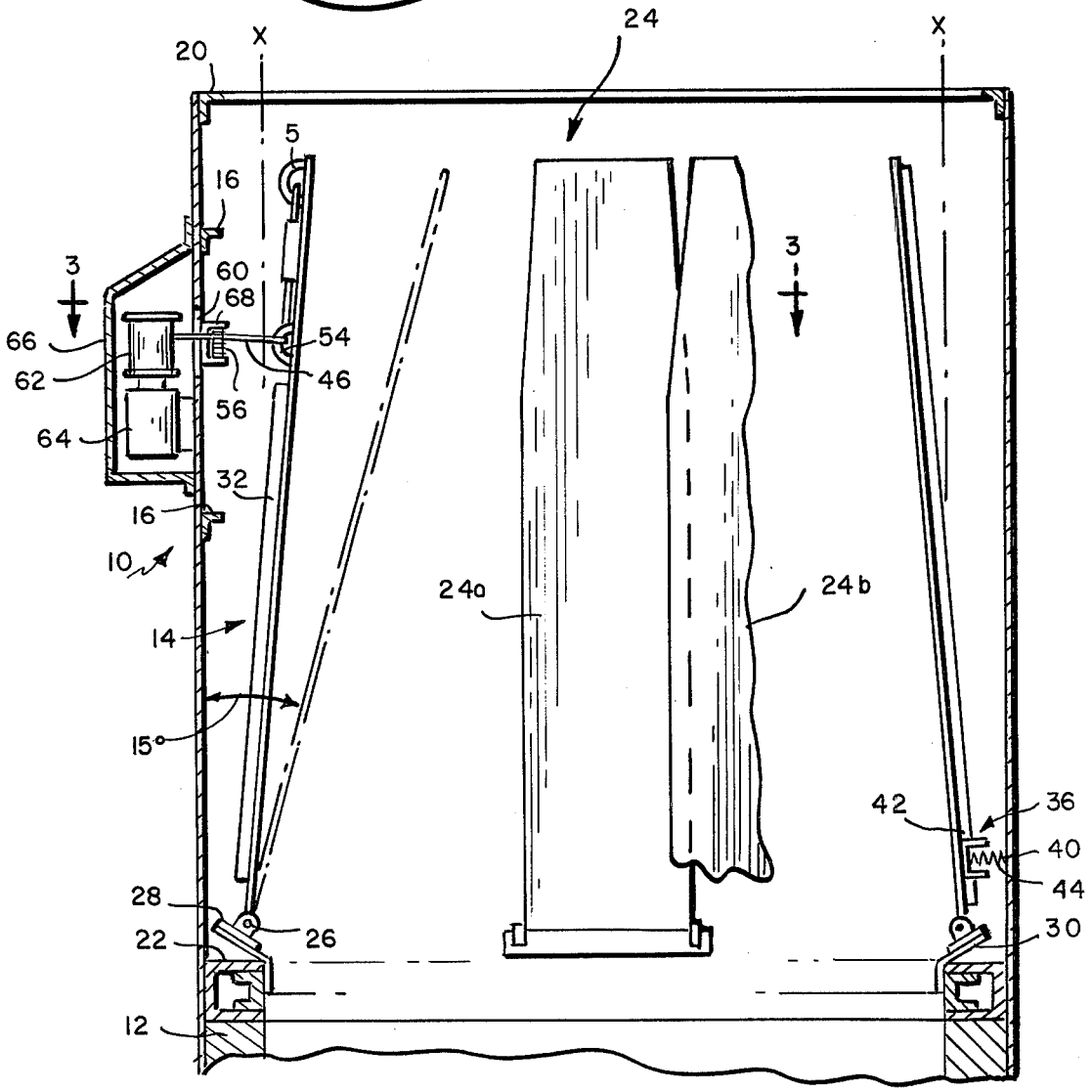
FIG. 2 is a diametral section to much larger scale taken on the line 2—2 of FIG. 1 showing parts in section and parts in elevation.

The device as herein illustrated is designed to disperse gases and any contaminating particles therein issuing from an industrial chimney or smokestack sufficiently so that the density of particles per unit area is within the limits imposed by federal regulations for antipollution and comprises a cylindrical shell 10, FIGS. 1 and 2, designed to be mounted at or near the top of the industrial chimney or smokestack which embodies means in the form of a variable pitch truncated cone 14 for maintaining a predetermined discharge velocity or velocity range so as to optimize the plume rise above the top of the chimney.

Referring to FIG. 2, there is shown a fragmentary portion 12 of an industrial chimney of predetermined inside diameter at the top of which there is mounted the cylindrical shell 10 within which the variable pitch truncated cone 12 is supported. The shell 10 corresponds substantially in inside diameter to the outside diameter of the chimney upon which it is mounted, is approximately ½ to 1½ the length of the diameter of the chimney and is internally reinforced by vertically spaced circumferential ring stiffeners 16. The upper end of the shell is reinforced by an annular cap 20 and the lower end is welded or otherwise secured to an annular supporting interface ring 22 which rests on the top of the chimney.

Figure 3A:
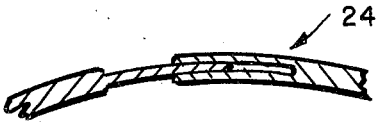
FIG. 3A shows an alternate construction of maintaining continuity of the flow path as the blades are contracted and expanded.
Figure 3:
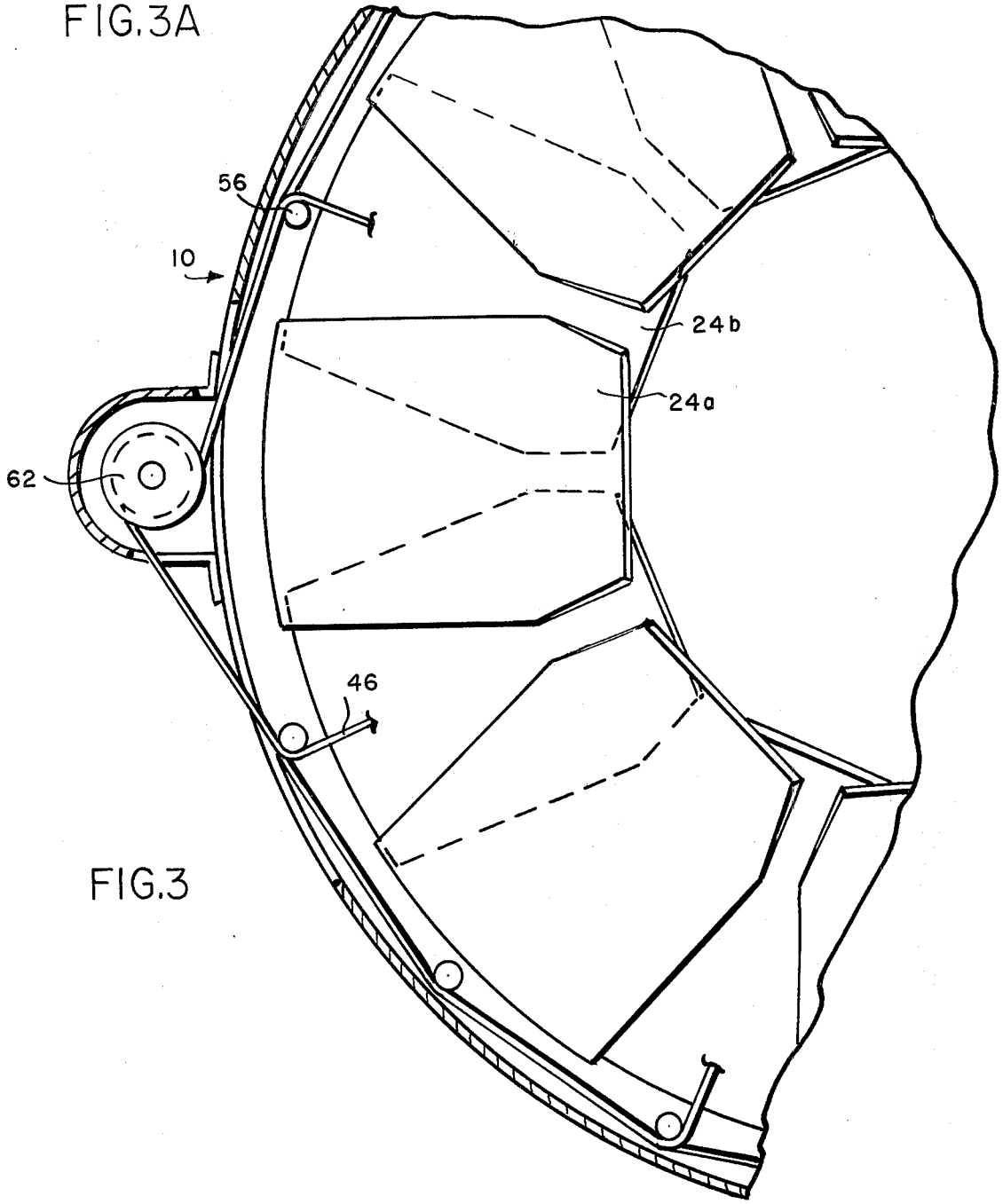
FIG. 3 is a partial horizontal section taken on the line 3—3 of FIG. 2.

The truncated cone 12 is comprised of a plurality of relatively narrow elongate blades 24 arranged circularly around the longitudinal axis of the chimney as a center with their lower ends connected by pivot pins 26 to brackets 28, the latter being fastened to a blade adapter ring 30 fastened to the inner side of the interface ring structure 22. The blades 24 are reinforced at their outer sides by stiffening members 32. As herein illustrated, there are 24 blades and, as illustrated in FIGS. 1 and 3, the blades overlap, there being an outer ring of blades **24*a* comprising the alternate blades and an inner ring of blades 24*b* comprising the intermediate blades, the arrangement being such that the opposite lateral edges of the blades 24*a* of the outer ring overlap the outer sides of the adjacent edges of the blades 24*b* of the inner ring. In order to reduce friction during expansion and contraction of the blades, the outer blades may have mounted thereto rollers 25 (FIG. 12**) or any other antifriction means for engagement with the inner blades. The number of blades may be varied in accordance with the inside diameter of the stack.

In order to insure control of the issuing column of gases, the axial length of the truncated cone should be approximately 1 to 1½ times the inside diameter of the chimney flue.

The blade assembly is mounted within the inside diameter of the shell 10 and an imaginary inner extension of the inside diameter of the chimney or stack which is represented by the dot and dash lines *x—x* so as to be outside the flow path defined by the inner side of the chimney to avoid any restriction to the gas flow through the chimney in the open position.

Figure 4:
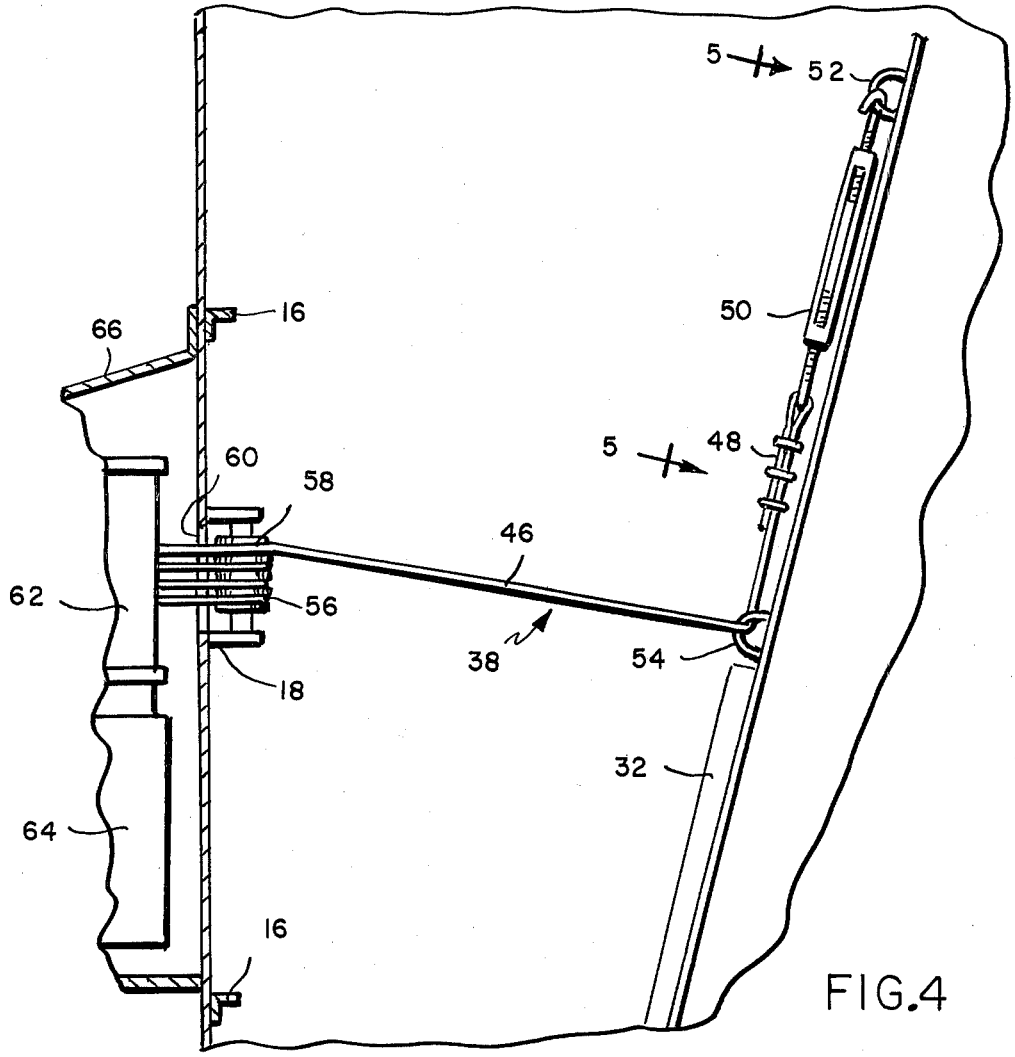
FIG. 4 is an elevation to larger scale of one kind of means for effecting movement of the blades outwardly.
Figure 6:
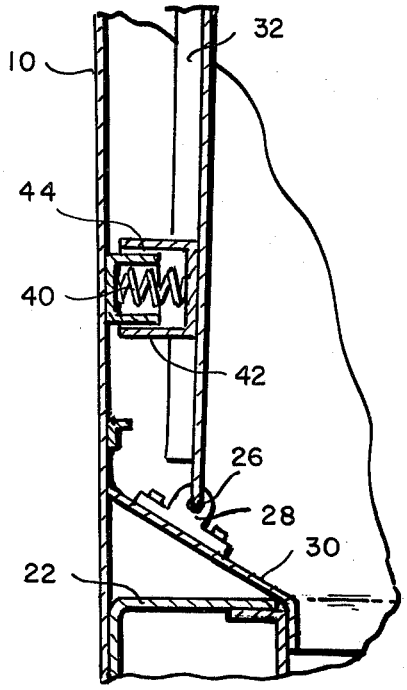
FIG. 6 is a fragmentary section to larger scale of the means for effecting movement of the blades inwardly.
Figure 5:
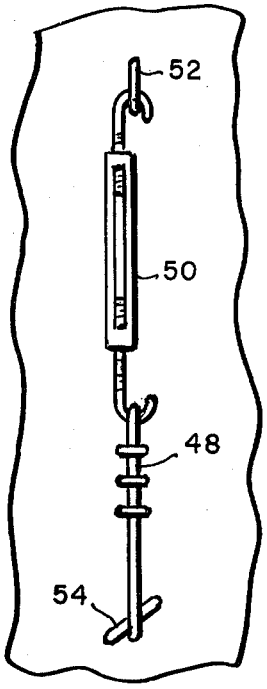
FIG. 5 is an elevation taken on the line 5—5 of FIG. 4.

In accordance with this invention, the blades of the blade assembly are moved angularly about their lower ends from positions in which they are substantially parallel to the wall of the shell 10 to positions inclined inwardly therefrom toward the axis of the chimney, FIG. 2, to provide for an emission velocity at the top of the chimney best suited for effecting plume height and dispersion performance of approximately 30 to 100 feet per second. Such angular movement may be provided, as shown in FIGS. 2, 3 and 4, by the combination of a plurality of spring means 36 which operate upon the blade of the outer ring of blades to yieldably bias them inwardly toward the axis of the chimney and a plurality of cable means 38, FIG. 4, connected to the outer side of the inner ring of blades for pulling the blades of the inner ring of blades outwardly. Because of the overlapping relation of the blades of the inner and outer ring of blades, the outward movement of the blades of the inner ring of blades moves the blades of the outer ring of blades outwardly and the spring means 36 which bias the blades of the outer ring of blades inwardly correspondingly moves the blades of the inner ring of blades inwardly. The spring means 36 comprise relatively stiff, heavy duty coils 40 disposed in radial positions with respect to the axis of the chimney in cups 42 and 44 secured, respectively, to the inside of the shell 10 and to the outer sides of the outer ring of blades. The cable means 38 comprise a plurality of cables 46 corresponding in number to the number of blades of the inner circle of blades. One end of each cable 46 is fastened by means of clamp members 48 to one end of a turnbuckle 50, the opposite end of which is connected to an eye 52 secured to the outer side of the blade. The cable 46 is threaded through an eye 54 spaced downwardly from the eye 52 and from thence outwardly toward the shell and about a pulley 56 containing a plurality of grooves 58 and from thence through an opening 60 in the shell onto a multigroove drum 62 of a power winch 64 mounted to the outer side of the shell within a protective housing 66. The pulleys 56 are mounted on U-shaped brackets 68 for rotation about vertical axes and the several peripherally disposed pulleys 56 support the cables from the respective blades adjacent the inner side of the wall from their place of engagement with the respective pulleys to the opening 60 through which they pass to the drum 62.

To provide for a fail-safe condition, that is, a structure so designed that the blades will automatically expand in the event that there is a power failure, the spring means may be connected under tension between the outer sides of the blades and the inner side of the shell so as to normally hold the blades expanded and linkage may be provided to push the blades inwardly.

The angular movement of the blades from their wide open expanded position to their closed contracted position should be approximately 15°, although this may vary with the size of the stack, the type of fuel, the draft, and ambient conditions of temperature and pressure. However, in any event, there should always be an overlap between the adjacent edges of adjacent blades throughout the angular movement of the blades to avoid any escape of the rising stream of gases which would interfere with the complete control of the velocity of issue. Instead of the aforesaid overlap, the edges of the blades may be provided with flexible fins and grooves for slidingly receiving the fins as shown in FIG. 3A.

Control of the angular movement of the blades may be provided for by the utilization of pressure temperature sensing means PT as diagrammatically illustrated in FIG. 11 which monitors the internal gas flow characteristics in a broach line or in the flue of the stack at a distance substantially above the broach entrance, to predict internal gas velocity characteristics which will then be utilized to determine the size of the flow path through the truncated cone, necessary to provide the desired or required gas exit velocity. Referring to FIG. 10, PT represents a pressure-sensitive sensor, the output of which is fed into an analog so designated which, in turn, sends a signal indicative the cone size required, to a reference selector or indicator which visually indicates the cone size so that the latter may be manually adjusted to the required size, or sends a signal to electrical or hydraulic means for automatically expanding or contracting the truncated cone the required amount. The pressure temperature means may, as related above, be located in a broach line indicated at PT in FIG. 11 where the broach line enters the broach opening of the chimney or in the chimney flue above the broach opening as also indicated at PT in FIG. 11. In either of the positions illustrated, the pressure temperature sensor should be in a nonturbulent portion of the path of the flowing gases. It is within the scope of the invention to employ pressure temperature sensing means other than that illustrated herein.

Figure 7:
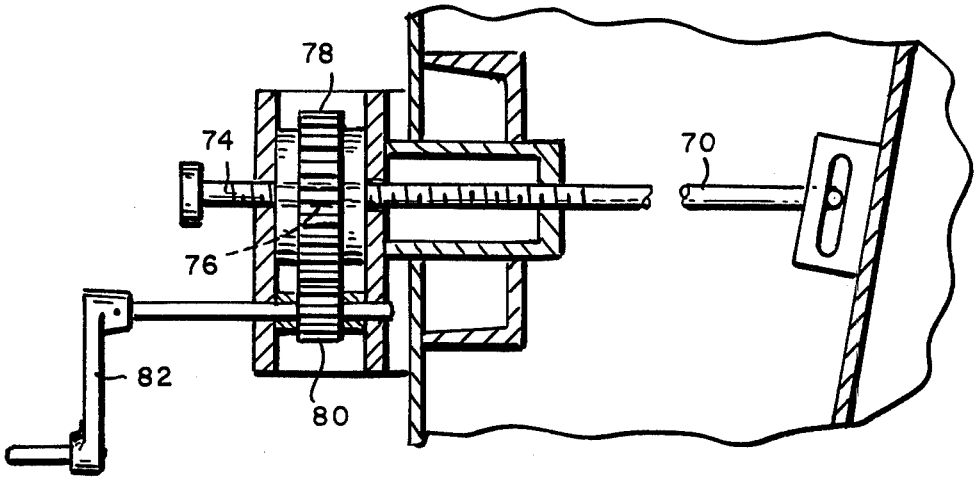
FIGS. 7, 8 and 9 show alternative means for moving the blades.
Figure 8:
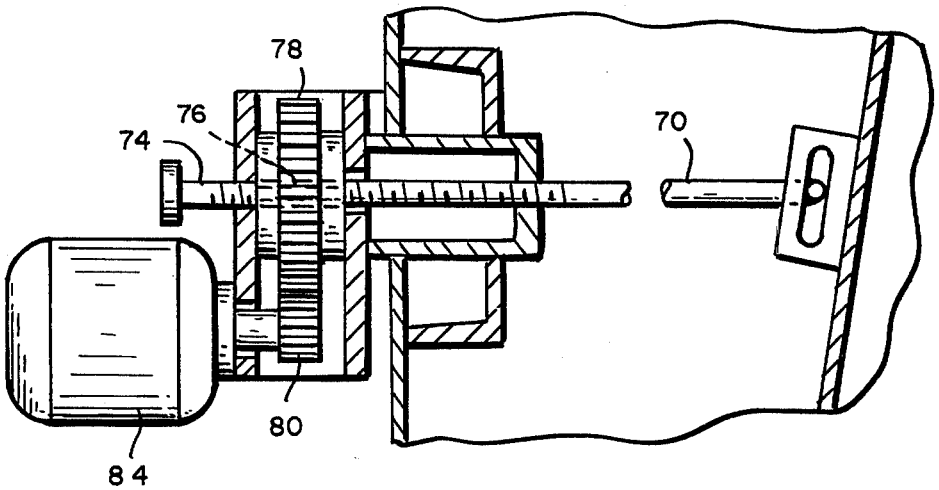
Figure 9:
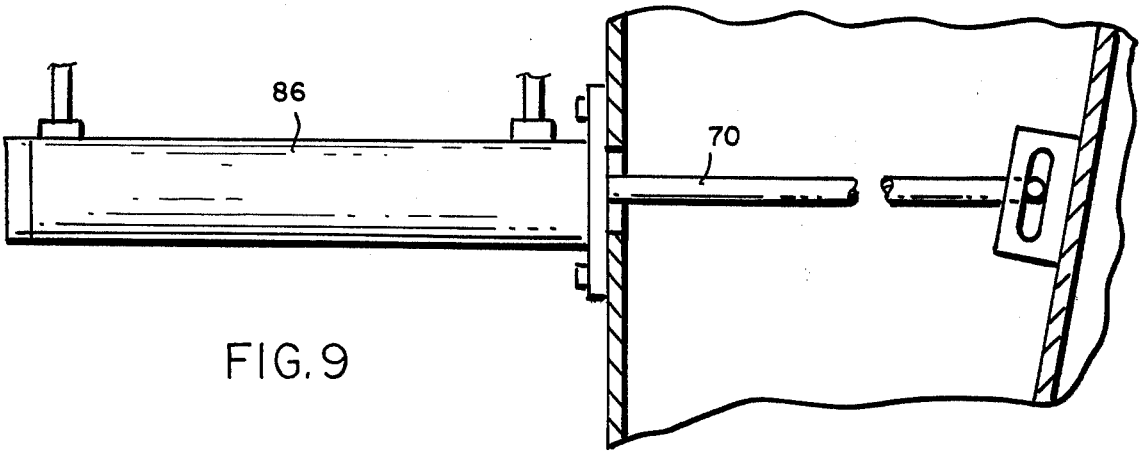

Alternatively, movement of the blades may be effected manually, as shown in FIG. 7, by means of rods 72 pivotally connected at their inner ends within the shell to the blades which have at their outer ends threaded portions 74 externally of the shell engaged within internally threaded gear wheels 76. Pinions 80 in mesh with the gear wheels 86 provide for rotating the gear wheels and hand cranks 82 provide for rotating the pinions. FIG. 8 shows a motor for driving the pinions. FIG. 9 shows hydraulic means comprising a double acting ram 86 for effecting movement of the rods 72. Operation of the motor 84 and ram 86 may be initiated manually or automatically.

The device is designed for use on stacks of any diameter, that specifically illustrated herein being designed for stacks varying from 5 to 20 feet in diameter. The blades are cut to fit a given stack diameter, rolled to a specific radius and coated according to the environment within which they are to be installed to resist corrosive action. Typically, a Teflon coating may be used or a glass laminate. Fluoroplastic materials can also be used in specific applications for corrosion protection. Similarly, the cables, turnbuckles, pulleys, rollers and the like are comprised of a material which is corrosion-resistant and suitably coated for this purpose.

It is to be understood that the device may be used in conjunction with single or multiflue chimney or stacks of single or double wall construction comprised of steel, concrete, bricks and/or combinations thereof, and that it may be mounted optionally at the top or near the top.

The expression "truncated cone" is used herein to describe a chamber defined by a closed side wall which tapers evenly from bottom to top whether the cross section of the structure is perfectly round or multisided.

The device as thus described is of relatively simple construction and may be mounted to an existing chimney structure or incorporated in a new chimney structure. As previously explained, its purpose is to control the velocity of issue of the gas or combustibles rising from the top of the stack so as to maintain a maximum plume rise of, for example, 30 to 100 feet before dispersion of the gases and any contaminant particles carried thereby, thus to reduce the density of particles per unit of area (ground level concentration) to within the limits imposed by pollution control laws. The relatively high velocity flow from the top of the unit counteracts the effect of aerodynamic downwashes and crosscurrent wind to an extent to maintain the integrity of the emission column rising from the chimney until it is far enough above the chimney for maximum dispersion.

It should be understood that the present disclosure is for the purpose of illustration only and includes all modifications or improvements which fall within the scope of the appended claims.

We claim:

1. The combination with a smokestack of means at the top of the stack defining a truncated conical chamber adapted to be expanded and contracted to vary the size of the discharge opening and electrically operable kinematic means effecting the expansion and contraction of said first means to obtain control of the gas exit velocity, thereby effecting maximum plume rise from the top of the chimney.

2. The combination according to claim 1 wherein the base diameter of the truncated conical chamber corresponds substantially in diameter to the diameter of the inside of the chimney flue.

3. The combination according to claim 1 wherein the axial length of the truncated conical chamber corresponds substantially in length to 1 to 1½ times the inside diameter of the chimney flue.

4. The combination with a smokestack of means at the top of the stack defining a truncated conical chamber, said means comprising a plurality of relatively long, narrow blades disposed in a circle about the axis of the stack for pivotal movement about their lower ends radially inwardly and outwardly relative to the axis of the stack and means for effecting expansion and contraction of said first means to obtain control of the gas exit velocity, thereby effecting maximum plume rise from the top of the chimney and wherein the longitudinal edges of the blades overlap.

5. The combination according to claim 4 wherein the means for effecting expansion and contraction is manually operable kinematic means.

6. The combination according to claim 4 wherein the means for effecting expansion and contraction is hydraulically operable kinematic means.

7. The combination according to claim 4 wherein expansion and contraction by said means for effecting expansion and contraction is determined by flow-sensitive means situated in the flow path.

8. The combination according to claim 4 wherein expansion and contraction by said means for effecting expansion and contraction is automatically determined by temperature pressure sensitive means situated in the flow path.

9. Apparatus according to claim 8 wherein the temperature pressure-sensitive means is mounted in the chimney in the unobstructed flow path of the gases and means operable by the response of said temperature pressure-sensitive means to changes in gas flow to effect operation of said second-named means.

10. Apparatus according to claim 4 comprising a cylindrical shell adapted to be mounted to the top of the chimney within which said relatively long, narrow blades are mounted.

11. The combination according to claim 4 comprising velocity sensing means for controlling operation of the means for effecting expansion and contraction of said first means in accordance with rate of emission so as to maintain a predetermined discharge rate at the top of the stack.

12. Apparatus according to claim 11 wherein the velocity-sensitive means comprises temperature pressure sensing means responsive to the flow path of the gases.

13. The combination with a smokestack of means at the top of the stack defining a truncated conical member adapted to be expanded and contracted to vary the size of the discharge opening, said means comprising a plurality of relatively long, narrow blades disposed in a circle about the axis of the stack for pivotal movement about their lower ends radially inwardly and outwardly relative to the axis of the stack and wherein the blades are arranged in inner and outer circles in overlapping relation such that movement of the blades of the outer circle inwardly effect a corresponding inward movement of the inner blades and movement of the inner blades outwardly effect a corresponding movement of the outer blades outwardly, and means for effecting expansion and contraction of said blades to obtain control of the gas exit velocity, thereby effecting maximum plume rise from the top of the chimney.

14. The combination with a smoke stack of means at the top of the stack defining a truncated conical chamber adapted to be expanded and contracted to vary the size of the discharge opening, said means comprising a plurality of relatively long, narrow blades disposed in a circle about the axis of the stack for pivotal movement about their lower ends radially inwardly and outwardly relative to the axis of the stack, said blades being arranged in inner and outer circles in overlapping relation such that movement of the blades of the outer circle inwardly effect a corresponding inward movement of the inner blades and movement of the inner blades outwardly effect a corresponding movement of the outer blades outwardly, spring means biasing the outer blades inwardly and means for effecting outward movement of the inner blades comprising cables connected at one end to the inner blades and to a winch at their outer ends and means for effecting rotation of the winch.

15. Apparatus according to claim 14 wherein a crank is provided for effecting rotation of the winch.

16. Apparatus according to claim 14 wherein a motor is provided for effecting rotation of the winch.

17. Apparatus according to claim 14 wherein the means for effecting outward movement of the blades comprises rods connected at one end to the inner blades, meshing worms and wheels at the outer ends of the rods and means for effecting rotation of the worm wheels.

18. The combination with a smoke stack of means at the top of the stack defining a truncated conical chamber adapted to be expanded and contracted to vary the size of the discharge opening, said means comprising a plurality of relatively long, narrow blades disposed in a circle about the axis of the stack for pivotal movement about their lower end radially inwardly and outwardly relative to the axis of the stack, said blades being arranged in inner and outer circles in overlapping relation such that movement of the blades of the outer circle inwardly effect a corresponding inward movement of the inner blades and movement of the inner blades outwardly effect a corresponding movement of the outer blades outwardly, spring means for spring biasing the outer blades inwardly and power-driven means including cords for effecting outward movement of the inner blades.

19. A velocity control module adapted to be mounted to the top of a chimney comprising a shell structure having an inside diameter greater than that of the chimney flue diameter, means mounted in the shell radially outwardly of the chimney flue defining a truncated conical chamber designed to be expanded and contracted to form an axially extending truncated conical flow path which may be varied in size, electrically operable kinematic means for effecting expansion and contraction of said means defining the truncated conical flow path and means operable to effect operation of the last means to maintain the velocity of discharge at a predetermined level.

20. A velocity control unit adapted to be mounted to the top of a chimney comprising a truncated variable pitch cone defining a conical flow path at the top of the chimney, the base diameter of which corresponds substantially to the diameter of the chimney flue so located as to be in axial alignment with the axis of the flue, said truncated cone being designed to be contracted and expanded to vary the size of the flow path, electrically operable kinematic means for effecting expansion and contraction of said truncated cone, and means operable to effect operation of said last-named means to obtain the velocity of discharge at a predetermined level.

* * * * *